United States Patent [19]

Besson

[11] 4,188,777

[45] Feb. 19, 1980

[54] ELECTRO-MECHANICAL CALENDAR WATCH

[75] Inventor: René Besson, Neuchatel, Switzerland

[73] Assignee: Ebauches S.A., Neuchatel, Switzerland

[21] Appl. No.: 838,050

[22] Filed: Sep. 30, 1977

[30] Foreign Application Priority Data

Oct. 4, 1976 [CH] Switzerland ..... 12508/76

[51] Int. Cl.[2] ..... G04B 19/24

[52] U.S. Cl. ..... 58/58; 58/4 A

[58] Field of Search ..... 58/4 R, 4 A, 23 D, 58, 58/85.5

[56] References Cited

U.S. PATENT DOCUMENTS

| | | | |
|---|---|---|---|
| 3,186,159 | 6/1965 | Schneiter | 58/58 |
| 3,333,410 | 8/1967 | Barbella | 58/4 R |
| 3,815,351 | 6/1974 | Vovelle | 58/58 |
| 3,911,667 | 10/1975 | Komiyama | 58/58 |

*Primary Examiner*—B. Dobeck
*Assistant Examiner*—William L. Feeney
*Attorney, Agent, or Firm*—Silverman, Cass & Singer, Ltd.

[57] ABSTRACT

An apparatus for advancing a date indicator of an electromechanical calendar watch. An hour indicator is driven through two normal operating revolutions of twelve hours each while keeping the date indicator fixed. The hour indicator then is driven through at least one more revolution at a speed much greater than the two normal operating revolutions to advance quickly the date indicator one day through a gearing connecting the hour indicator to the date indicator.

9 Claims, 5 Drawing Figures

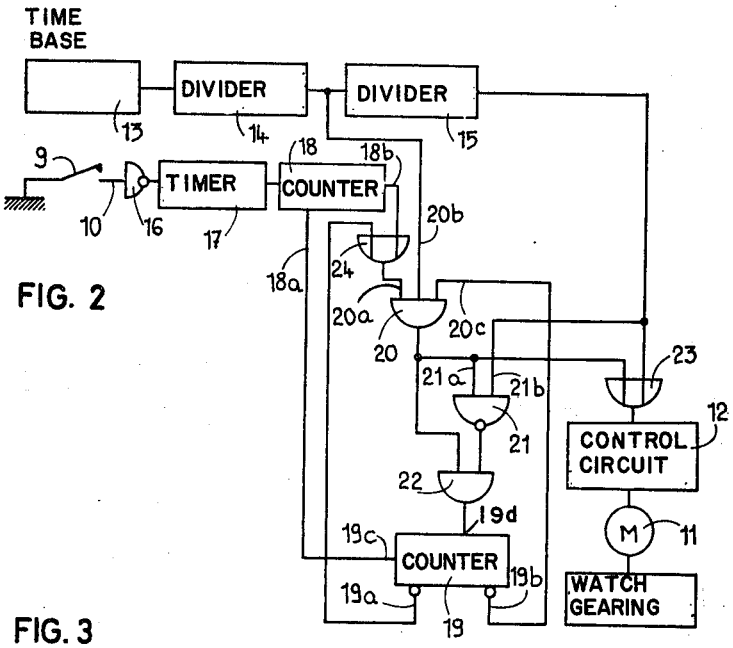
FIG. 2
FIG. 3
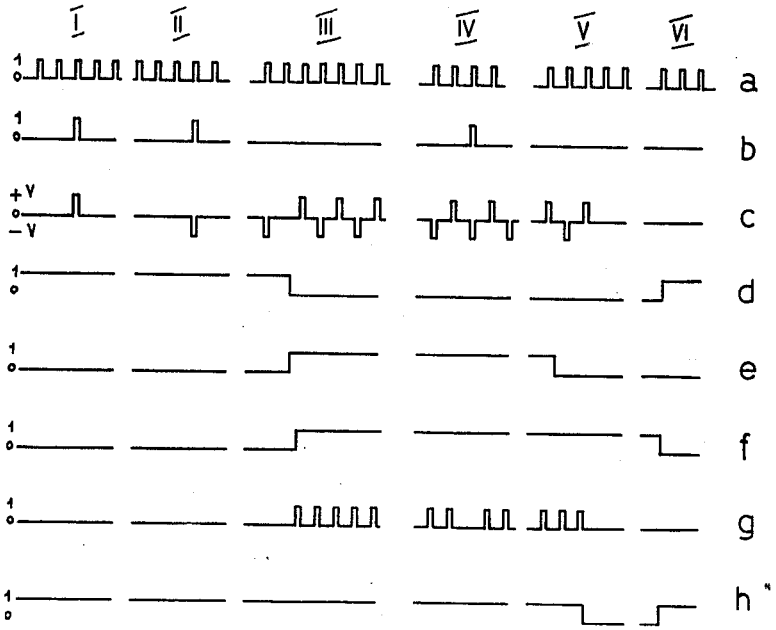

ELECTRO-MECHANICAL CALENDAR WATCH

The present invention relates to an electro-mechanical calendar watch, comprising a reducing gearing connecting the hour wheel to a driving wheel of a calendar indicating member which advances one step each twenty-four hours in a step by step manner.

This watch is characterized by the fact that the reducing gearing has a division rate which is a whole number greater than two. The date indicating member advances one step only after the hour wheel has made two whole revolutions at its normal speed of one revolution per twelve hours. The hour wheel then is driven, after the said two revolutions, at a speed which is higher than the date normal speed, on at least one revolution during which is produces the advance of the date indicating member.

The drawing shows, by way of example, two embodiments of the object of the invention.

FIG. 2 shows the block diagram of the control circuit of this watch.

FIG. 3 shows the several logic states of some points of this control circuit.

Figure 1:
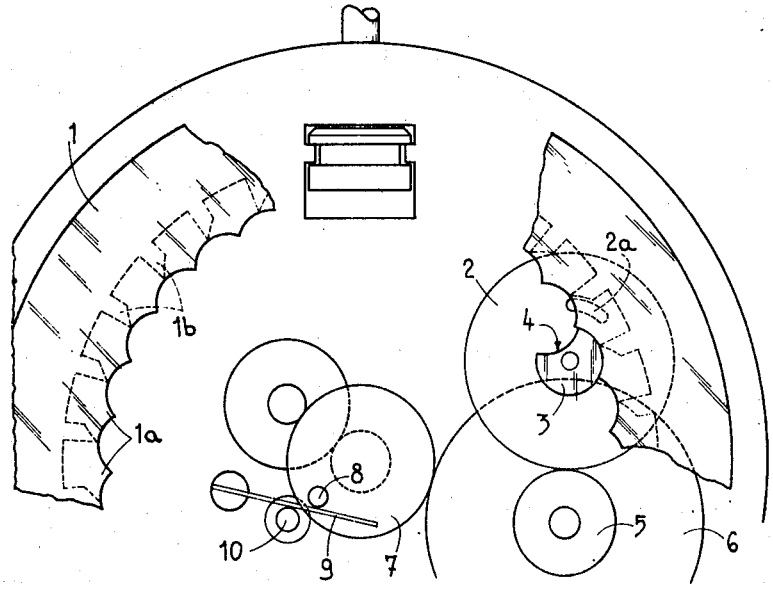
FIG. 1 is a plan view of a portion of a first embodiment of an electro-mechanical calendar watch.

The watch according to the first embodiment as represented comprises a date indicator 1, having the shape of a crown, presenting two inner gear teeth, one of which, designated by 1*a*, has the shape of a festoon, and the other of which comprises teeth 1*b* provided in half the thickness of the said crown.

The driving mechanism for the date indicator which is driven by the movement of the watch comprises a driving wheel 2 carrying an arc-of-circle shaped protrusion 2*a* cooperating, once per revolution, with the teeth 1*b* of the crown 1 for driving it one step. This wheel 2 carries a plate 3, provided with an arc-of-circle shaped notch 4, which cooperates with the teeth 1*a* for ensuring the locking of the crown 1 when it is not driven. The wheel 2 is driven by a pinion 5 fixed on a wheel 6 which is itself meshing with the hour cannon wheel designated by 7. Hour wheel 7 carries a driving pin 8 cooperating, once per revolution, with a resilient blade 9 for bringing it into contact with a stud 10.

The rate of division between the hour cannon wheel 7 and the driving wheel 2 is a whole number greater than 2, the arrangement being such that the wheel 2 operates the date crown 1 only when the hour wheel 7 has made more than two whole revolutions at its normal speed of one revolution per twelve hours.

Owing to means which are disclosed hereafter, the hour wheel 7 then is driven at a speed higher than its normal speed, the protrusion 2*a* of the driving wheel 2 being meshed with the teeth 1*b* of the date indicating crown 1, which produces a rapid advance of this crown.

The driving motor of the indicating elements of the watch, designated by 11, is itself driven by a control circuit 12 receiving pulses from a time base 13 constituted, for instance, by a quartz resonator the output signals of which are successively divided by two frequency dividers 14 and 15.

The circuit as represented in FIG. 2 comprises moreover a logic circuit "of date" controlling the rapid advance of the motor during the date advancing. This logic circuit comprises the switch 9–10, an inverter 16, a timer 17, two counters 18 and 19, three AND gates 20, 21 and 22, the AND gate 21 being inverted, and two OR gates 23 and 24.

The timer 17 is intended to prevent an improper closing of the switch 9–10, due for instance to a shock, from causing the operation of the device. Its output delivers a signal 1 only when its input receives a signal 1 for a time longer than its delay time T.

The content of the counter 18 can be equal to 0, 1, or 2. The output 18*a* of the counter 18 is at the logic state 1 when the content of this counter is equal to 1, while the output 18*b* is at the logic state 1 when the content of the counter is equal to 2.

The counter 19 has a capacity of 1441, its content being able to pass from 0 to 1440. The inverted output 19*a* of the counter 19 is at the logic state 0 when the content of this counter is equal to 0, the inverted output 19*b* is at the logic state 0 when the content of the counter is equal to 1440. This counter 19 has a reset to zero input 19*c*.

This circuit operates as follows:

The signals coming from the time base 13, at a frequency of 32 kHz, are divided by the first frequency divider 14 to a frequency of 64 Hz. The second frequency divider 15 divides this signal to a frequency of 1/30 Hz. In normal running condition, this signal at 1/30 Hz drives the control circuit 12 of the motor 11 through the OR gate 23.

At the passage of noon, the hour wheel 7 closes the contact 9–10 in such a way that the input of the inverter 16 is then at the logic state 0 and its output at the logic state 1. After the time T, the output of the timer 17 passes to the logic state 1. The signal produced by the closing of the contact 9–10 increases by one unit the content of the counter 18 which, up to now, was at 0, and consequently passes to 1, which brings its output 18*a* to the logic state 1 and resets to 0 the counter 19 by its input 19*c*. Consequently, the inverted output 19*a* of the counter 19 is at the logic state 0 and its inverted output 19*b* at the logic state 1, the content of the counter being other than 1440.

At the passage of midnight the hour wheel 7 again closes the contact 9–10 so that the input of the inverter 16 is then at the logic state 0 and its output at the logic state 1. After the time T, this signal increases by one unit the content of the counter 18 which passes from 1 to 2, which brings its output 18*b* to the logic state 1. This logic signal 1 is applied to the input 20*a* of the AND gate 20 through the OR gate 24. The AND gate 20 this way permits the passage of the pulses coming from the output of the frequency divider 14, applied to its input 20*b*, its input 20*c* being also at the logic state 1, due to the fact that the output 19*b* of the counter 19 is at the logic state 1. Consequently, the 64 Hz signal is found again at the output of the AND gate 20, which signal is applied to the input of the OR gate 23 and then, to the control circuit 12 of the motor 11. Consequently, the motor rotates at 64 steps per second. The output signal of the AND gate 20 is also applied to the input 19*a*, of counter 19 through the AND gate 22. To this effect it is necessary that this AND gate 22 be inabled, that is to say that the inverted output of the inverted AND gate 21 be at the logic state 1. Now, the input 21*a* of the inverted AND gate 21 is connected to the output of the AND gate 20. Consequently, this input 21*a* receives the 64 Hz signal. The input 21*b* is connected to the output of the frequency divider 15 which is at the logic state 1 only once every thirty seconds. Consequently, so long as the frequency divider 15 does not emit pulses for advancing the motor 11 one step, incrementing by thirty seconds the state of the watch, the input 21*b* of the inverted AND gate 21 remains permanently at the logic state 0 and, consequently, its output remains at the logic state 1, so that all the pulses are counted by the counter 19. When this counter has received 1440 pulses, which corresponds to the number of pulses the motor 11 must receive for making the hour wheel 7 rotate one whole revolution, the output 19*b* of the counter 19 passes from the logic state 1 to the logic state 0, which locks the AND gate 20. The motor 11 is then no longer driven by the 64 Hz signal.

If, during the driving of the motor 11 at high speed, the frequency divider 15 sends a driving pulse to the motor, this pulse is applied to the input 21*b* of the inverted AND gate 21. Its two inputs 21*a* and 21*b* being simultaneously at the logic state 1, while its output is at the logic state 0, which prevents the pulse coming from the AND gate 20 from passing through the AND gate 22. Consequently, the counter 19 does not count this pulse. This way, the motor 11 makes an advance of 1441 steps, that is to say 1440 steps for rotating the hour hand one revolution and one step for making the watch advance thirty seconds, these thirty seconds corresponding to the normal advance of the hands of the watch. One sees thus that the AND inverted gate 21 plays the role of a safety circuit.

Even if, during the advancing of the date indicator, the contact 9-10 becomes closed, which brings the content of the counter 18 from 2 to 0, that is to say its output 18*b* passes from the logic state 1 to the logic state 0, the driving of the motor at high speed continues until the counter 19 has reached the value 1440, the output 19*a* of the counter 19 maintaining the input 20*a* of the AND gate 20 at the logic state 1, through the OR gate 24. This function is necessary since one cannot guarantee with an absolute precision the time of closing of the contact 9-10 after the whole driving revolution of the date indicator.

FIG. 3 shows the several logic states of some points of the control circuit:

Portion a indicates the logic states at the output of the frequency divider 14, where the frequency is 64 Hz.

Portion b indicates the logic states at the output of the frequency divider 15, where the frequency is 1/30 Hz.

Portion c indicates the voltages at the output of the control circuit 12 for the motor.

Portion d indicates the logic states at the output 18*a* of the counter 18.

Portion e indicates the logic states at the output 18*b* of the counter 18.

Portion f indicates the logic states at the output 19*a* of the counter 19.

Portion g indicates the logic states at the input 19*d* of the counter 19, and Portion h indicates the logic states at the output 19*b* of the counter 19.

Columns I and II correspond to the normal running of the watch after noon.

Column III corresponds to the beginning of the high speed driving, at the passage at midnight.

Column IV corresponds to high speed running when the frequency divider 15 emits a driving pulse.

Column V corresponds to the end of the high speed driving.

Column VI corresponds to the closing of the contact 9-10 at the passage at noon.

In the example as disclosed and represented, the date indicating member is controlled after the hour wheel has made two whole revolutions at its normal speed of one revolution per twelve hours, and during a third revolution during which it is driven at a much higher speed. As a modification, one could have the case where the hour wheel will effect a whole number of revolutions, greater than 1 , at high speed for producing the driving of the date indicating member.

Figure 4:
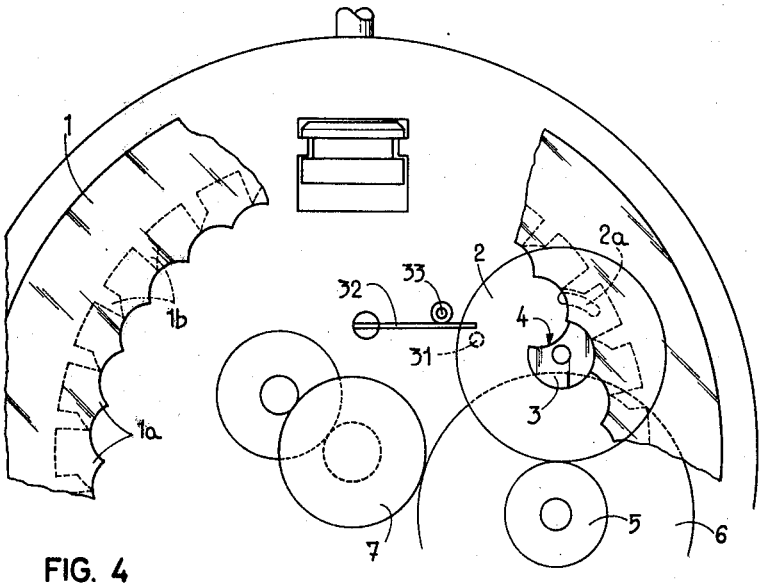
FIG. 4 is a plan view of a portion of a second embodiment of an electro-mechanical calendar watch.
Figure 5:
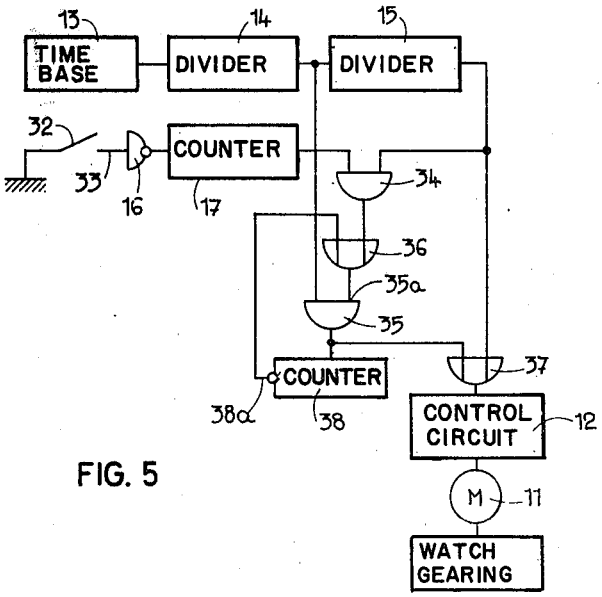
FIG. 5 shows the block-diagram of the control circuit of this watch.

In the second embodiment (FIGS. 4 and 5), the contact device 8-9-10 of the first embodiment is replaced by a pin 31, carried by the date indicator driving wheel 2 which cooperates with a resilient blade 32 for bringing it, once per revolution, into contact with a stud 33. This arrangement has the advantage, with respect to the first embodiment, that the resilient blade and the contact stud are away from the center of the watch where the available room is very limited.

The electronic circuit is also more simple in this embodiment than in the first one. It shows (FIG. 5) two AND gates 34 and 35, two OR gates 36 and 37, and a counter 38 able to count from 0 to 1440.

The control circuit 12 of the motor 11, as well as the time base 13, the frequency dividers 14 and 15, the inverter 16 and the timer 17 are identical to the first embodiment.

The contact 32-33 is closed at about midnight, after a pulse of normal advance has been delivered by the divider 15. The next pulse delivered by divider 15, at the same time it produces the advance of the motor through the OR gates 37, passes through the AND gate 34 and OR gate 36 for reaching, at the same time as the pulse delivered at this moment by the divider 14, the AND gate 35. This pulse, which consequently appears at the output of this AND gate 35, increments by one unit the content of the counter 38 which passes, consequently, from 0 to 1. The inverted output 38*a*, which was at the logic state 0, passes to the logic state 1. This signal 1 comes, through the intermediary of the OR gate 36, to the input of the AND gate 35 which consequently allows the passage, from this time on, of the pulses coming from the divider 14. These pulses produce the advance of the motor 11, by the intermediary of the OR gate 37, at a rate of 64 steps per second, and increment the contant of the counter 38.

It is to be noted that the pulse which brings the content of the counter 38 to pass from 0 to 1 coincides with the pulse of normal advance of the motor. Consequently, the first supplementary pulse brings this content to pass from 1 to 2, and so on. Consequently, the 1439th supplementary pulse brings the content of the counter 38 to pass to 1440. The 1440th pulse, which ends the rotation of one whole revolution of the hour indicator, brings the content of the counter 38 to pass from 1440 to 0. Then the output 38*a* passes again to the logic state 0. As, during this rotation, the contact 32-33 has become opened, the pulses delivered by the divider 14 can consequently no longer reach the input of the counter 38 which remains in the state it has just taken.

What I claim is:

1. An electromechanical calendar watch comprising:

date indicator means mounted in said watch for indicating the days of a month, said means being advanceable to change the indicated day once every 24 hours;

hour indicator means revolving in said watch for indicating hours of each day during two normal revolutions of 12 hours each;

gear means coupled to said date indicator means and said hour indicator means for advancing said date indicator means one day during at least a third revolution of said hour indicator means occurring after said two normal revolutions;

drive means coupled to one of said date indicator means, said hour indicator means and said gear means, for driving said date indicator means, said hour indicator means and said gear means; and control means coupled to said drive means and said hour indicator means for controlling said drive means at a normal operating speed during said two normal revolutions of said hour indicator means and at an advancing speed which is significantly greater than normal operating speed during said third revolution of said hour indicator means.

2. A watch as claimed in claim 1 further including piezoelectric resonator means mounted in said watch for producing a high frequency electrical signal; and divider means coupled to said high frequency signal for dividing said high frequency signal into a normal operating frequency signal and an advancing frequency signal, said advancing signal having a frequency greater then said normal operating signal; and in which said drive means include an electric motor; said control means further are coupled to said normal operating signal during said two normal revolutions of said hour indicator means to control said motor at said normal operating speed with said normal operating frequency; and said control means further are coupled to said advancing signal during said third revolution of said hour indicating means to control said motor at said advancing speed with said advancing frequency.

3. A watch as claimed in claim 2 further including logic circuit means for switchably coupling said advancing signal to said control means, said logic circuit means including switch means adjacent control member means on one of said date indicator means, said hour indicator means and said gear means actuated once each revolution of said hour indicator means by control member means for switching said logic circuit means between coupling and uncoupling said advancing signal to said control means.

4. A watch as claimed in claim 3 in which said hour indicator means include said control member means.

5. A watch as claimed in claim 3 in which said logic circuit means further include first counter means coupled to said switch means, said advancing signal and said control means, for coupling said advancing signal to said control means upon a first predetermined number of actuations of said switch means.

6. A watch as claimed in claim 5 in which said logic circuit means further include second counter means coupled to said advancing signal after said first predetermined number of actuations of said switch means and said normal operating signal, for maintaining said coupling of said advancing signal to said control means as long as the count of pulses of said advancing signal counted by said second counter means is less than a predetermined count.

7. A watch as claimed in claim 6 in which said first counter means further include means for producing a reset to zero signal upon a second predetermined number of actuations of said switch means and said second counter means are coupled to said reset to zero signal to reset said second counter means to zero count.

8. A watch as claimed in claim 6 in which said logic circuit means include safety circuit means coupled to said second counter means and said advancing and normal operating signals for disabling said second counter means while said normal operating signal is delivering a pulse.

9. A watch as claimed in claim 3 in which said date indicator means include said control member means.

* * * * *